United States Patent [19]

Bajulaz

[11] Patent Number: 4,487,168

[45] Date of Patent: Dec. 11, 1984

[54] MACHINE HAVING OSCILLATING CHAMBERS AND PISTONS

[76] Inventor: Roger Bajulaz, 825 Las Palmas Dr. - Hope Ranch, Santa Barbara, Calif. 93110

[21] Appl. No.: 403,130

[22] Filed: Jul. 29, 1982

[30] Foreign Application Priority Data

Mar. 25, 1982 [CH] Switzerland ..... 1834/82

[51] Int. Cl.[3] ..... F01C 1/02; F04C 1/02; F02B 55/14

[52] U.S. Cl. ..... 123/18 R; 123/43 R; 123/43 B; 123/18 A; 123/58 C

[58] Field of Search ..... 123/43 R, 43 A, 43 B, 123/42, 18 R, 18 A, 58 R, 58 B, 58 BA, 58 C

[56] References Cited

U.S. PATENT DOCUMENTS

| | | | |
|---|---|---|---|
| 953,868 | 4/1910 | Tcherepanoff | 123/43 B |
| 1,869,440 | 8/1932 | Schlenker | 123/58 BI |
| 3,229,677 | 1/1966 | Hughes | 123/43 B |
| 3,333,577 | 8/1967 | Mongitore | 123/18 R |
| 3,451,382 | 6/1969 | Huff | 123/18 |
| 4,021,158 | 5/1977 | Bajulaz | 418/52 |

FOREIGN PATENT DOCUMENTS

| | | |
|---|---|---|
| 1384583 | 8/1965 | France . |
| 2322282 | 3/1977 | France . |
| 2054043 | 2/1981 | United Kingdom . |

*Primary Examiner*—Craig R. Feinberg
*Assistant Examiner*—David A. Okonsky

[57] ABSTRACT

The machine comprises at least one central pivot 7 angularly fast with a control member 1 and mounted for oscillation on said control member 1 around a direction perpendicular to the axis of the control member 1 and a first eccentric 31 the axis of the active portion of which 33 passes through the intersection of the axes of the control member 1 and of the central pivot 7.

A piston 22 turns on the active part 33 of the eccentric 31 and is pivoted concentrically to the axis of the central pivot 7. This piston comprises at least one active face 24 moving within at least one chamber 8 to modify its volume. It comprises further cinematic means 37, 38, 41 imposing a relative rotation between the eccentric 31 and the control member 1.

The walls 10, 11 of the chamber 8 are fast with the central pivot 7.

27 Claims, 11 Drawing Figures

MACHINE HAVING OSCILLATING CHAMBERS AND PISTONS

The present invention relates to a machine with pistons having a non linear movement which can be used, among others, as a combustion engine, as a compressor, as a pump and so on, avoiding linear movements of movable parts.

The aim of the present invention is to provide a machine of simple and robust construction in which the sealing problems, as well as the wear and maintenance problems are solved.

Such machines have been proposed, for example the one described in the U.S. Pat. No. 4,021,158. These existing machines have some drawbacks due to the fact that the pistons have a rotational movement on themselves, complicating their cinematic linkage to the machine shaft and causing sealing problems between the pistons along their hinging line and necessitating the use of spherical pistons and chambers. Having no continuous longitudinal shaft, these machines are not well adapted to transmit torque.

The pistons having a rotational movement with respect to the chambers in which they move, only the spherical shape can be used. These relative movements which do not take place along only one direction cause sealing difficulties between the pistons and their chambers.

Another problem of all internal combustion engines is caused by the very high pressures existing between the pistons and their chambers leading to important deformations of the chambers, for example the ovalization of the cylinders and the wear of the piston in the common motors.

The present invention has further for its object to provide such a machine in which the pistons do not rotate on themselves during the working cycle and have simply an angular movement with respect to their chambers and in which the pressure between the pistons and the chambers, due to the compression and explosions, is cancelled.

The attached drawings show schematically and by way of example one embodiment and some variants of the machine according to the invention.

Figure 1:
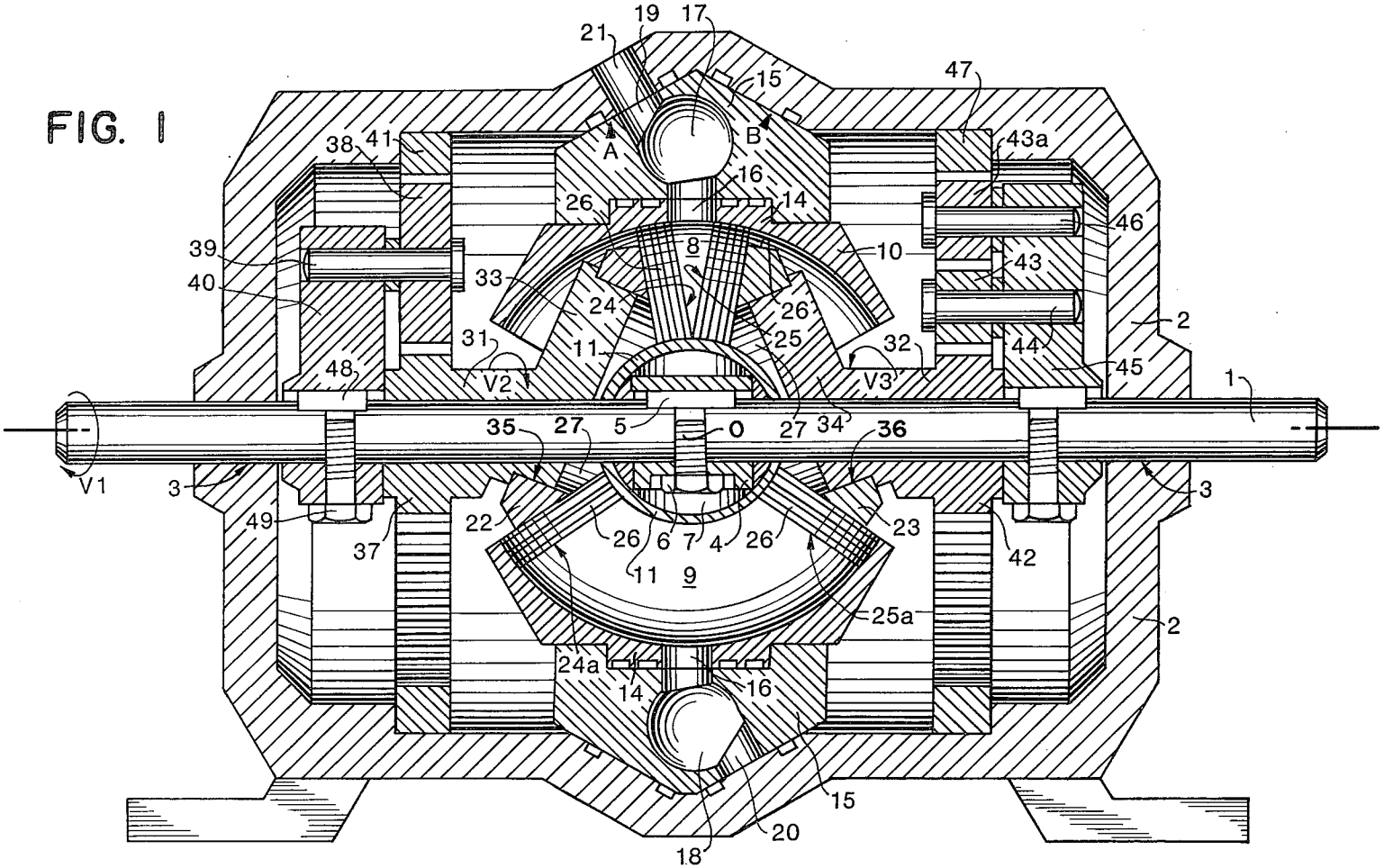
FIG. 1 is a longitudinal cross section of a machine according to the invention, the pistons being in one of their extreme positions, the machine having only one active unit corresponding to a two cylinder machine.
Figure 2:
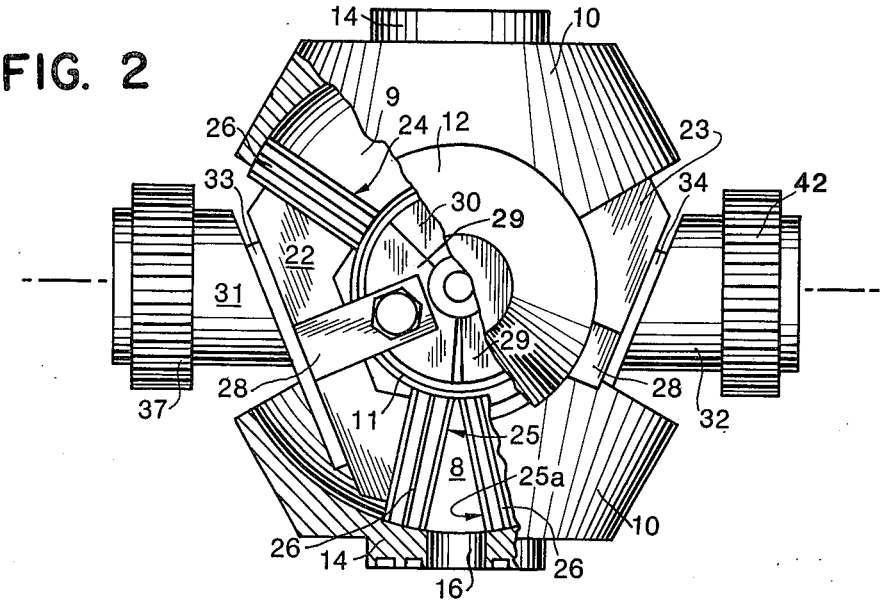
FIG. 2 is a partial top view, certain parts being cut or withdrawn, of the machine in its position shown in FIG. 1.

The machine shown in FIGS. 1 to 6 comprises only one active unit for the simplicity of the drawing and the description. It is evident that in practice a machine could comprise several active units, four, six or more for example, coupled together.

This machine comprises a control member comprising a through axle 1 journaled on a frame 2 in two bearings 3. A central cylindrical bearing 4 is carried by the axle 1, the axis x—x of this central bearing 4 is perpendicular to the axis of the axle 1. This bearing 4 is angularly fast with the axle 1 by means of a pin 5 and axially fast with said axle 1 by means of a screw 6.

This cylindrical central bearing 4 is used as a hinge for a central pivot 7 the longitudinal axis of which cuts the axis of the through axle 1 at 0. This central pivot 7 is thus fast angularly and axially with the through axle 1 but is able to oscillate with respect to said axle 1 in a plane defined by the axis of the said central pivot 7 and that of the through axle 1. The axis of the central pivot 7 can thus incline itself with respect to the axis of the through axle 1.

In this embodiment, the through axle 1 constitutes simultaneously a control member of the central pivot 7 to which it is mechanically connected.

The unitary machine shown comprises further two chambers 8, 9, each formed by a first outer shell 10 and a second inside shell 11 the upper and lower ends of which are fitted the ones on the others and secured together as well as to the ends of the central pivot 7 by means of locks 12 fastened to the central pivot 7 by means of screws 13.

Each outside shell 10 comprises a cylindrical boss 14 the axis of which passes through the intersection 0 of the axis of the central pivot 7 and of the through axle 1 and is perpendicular to said two axes.

A circular distribution ring 15 surrounds the two outer shells 10 and comprises two housings receiving the bosses 14 of these shells 10. This distribution ring 15 is thus fast angularly with the shells 10 and thus with the central pivot 7 and with the through axle 1.

Seals are provided between the shells 10 and the distribution ring.

A passage 16 is provided in the cylindrical bosses 14 of the outside shells 10 connecting the chamber 8 respectively 9 to a housing 17, respectively 18 provided in the distribution ring 15. These housings 17, 18 communicate, as seen later on, through a passage 19, 20 with openings 21 provided in the frame 2, these openings being themselves connected to admission respectively output or exhaust ducts of the machine, as well as to the ignition device of the machine.

Seals are provided between the distribution ring 15 and the frame 2.

The unitary machine shown comprises further two double pistons 22, 23, having each two active faces 24, 24*a*, respectively 25, 25*a* moving freely within the chambers 8 and 9. These active faces 24, 25 of the pistons are made by parts built-up on the pistons 22, 23. These built-up parts 26 can slide in their plane with respect to the pistons so as to ensure an automatic centering of these parts in the chambers 8, 9. These built-up parts 26 comprise sealing elements, for example in the form of segments, ensuring a perfect seal between their edges and the internal walls of the chambers 8, 9 defined by the shells 10, 11.

The pistons 22, 23, have each an opening 27 giving passage to the through axle 1, and comprise arms 28 at their upper and lower ends. These arms 28 carry guiding slides 29 sliding in cups 30 provided in the ends of the central pivot 7. In this way the piston are maintained in a fixed axial position with respect to the central pivot 7 and are pivoted concentrically on said pivot.

These arms extend beyond the upper and lower ends of the active faces of the pistons.

In this way, a perfect guiding of the pistons in the chambers is achieved and the pistons move freely within the chambers without any contact with them other than that due to the sealing segments.

The unitary machine shown comprises further eccentrics 31, 32 journaled in the example shown concentrically with the through axle 1 and the active portions of which 33, 34 have axes which intersect at point 0 where the axes to the central pivot 7 and of the through axle also intersect. These active parts of the eccentrics turns in housings 35, 36 provided in the pistons 22, 23. It is to be noted that each active portion of the eccentrics 33, 34 is traversed throughout by the through axle 1, which permits a construction in which these eccentrics have large dimensions while ensuring an important angle between the axis of said eccentrics and the axis of the through axle 1, enabling a great angular displacement of the pistons with respect to each other.

This unitary machine comprises further kinematic means imposing a relative rotation between at least one of the eccentrics 31, 32 and the through axle 1. In the example shown, the two eccentrics 31, 32 are driven in rotation with respect to the through axle 1. A first kinematic linkage connects the eccentric 31 to the passing axle 1 and a second kinematic linkage connects the eccentric 32 to said through axle 1.

The kinematic linkage between the eccentric 31 and the through axle 1 comprises a toothed pinion 37 fast with the eccentric 31 and concentric with the through axle 1, meshing with a pinion 38 idly pivoted on a shaft 39 fast with a crank 40 itself fast with the through axle 1 by means of a pin 48 and a screw 49. This idle Planet pinion 38 meshes also with a toothed crown 41 rigidly fixed on the frame 2. The demultiplication ratio of this kinematic linkage is such that the eccentric 31 revolves around the through axle 1 at a speed V2 always greater than the speed of rotation V1 of the through axle and in the same direction as the through axle.

The kinematic linkage connecting the eccentric 32 to the through axle 1 comprises a pinion 42 fast with the eccentric and concentric to the through axle 1, meshing with a first Planet pinion 43 idly pivoted on an axis 44 fast with a crank 45 itself fast with the through axle 1 by means of a pin and a screw. This crank 45 carries a second axle 46 on which is idly journaled a second Planet pinion **43*a* in mesh, on the one hand with the first Planet pinion 43 and on the other hand with a toothed crown 47 fast with the frame 2. The demultiplication ratio of this kinematic linkage is such that the speed of rotation V3 of the eccentric 32 around the through axle 1 is identical to the absolute value of the speed of rotation of the eccentric 31 around this same shaft 1, but in the opposite direction. One imposes by these cinematic linkages the relation $|V2| = |V3| > |V1|$. In this example of a machine, each piston 22, 23 executes within the corresponding chambers 8, 9, two cycles for one revolution of the through axle 1**. To obtain these four movements of each piston, the demultiplication ratio of the kinematic linkages is 1:2. By modifying these ratios one obtains a different number of reciprocations of the pistons for one revolution of the through axle.

Figure 3:
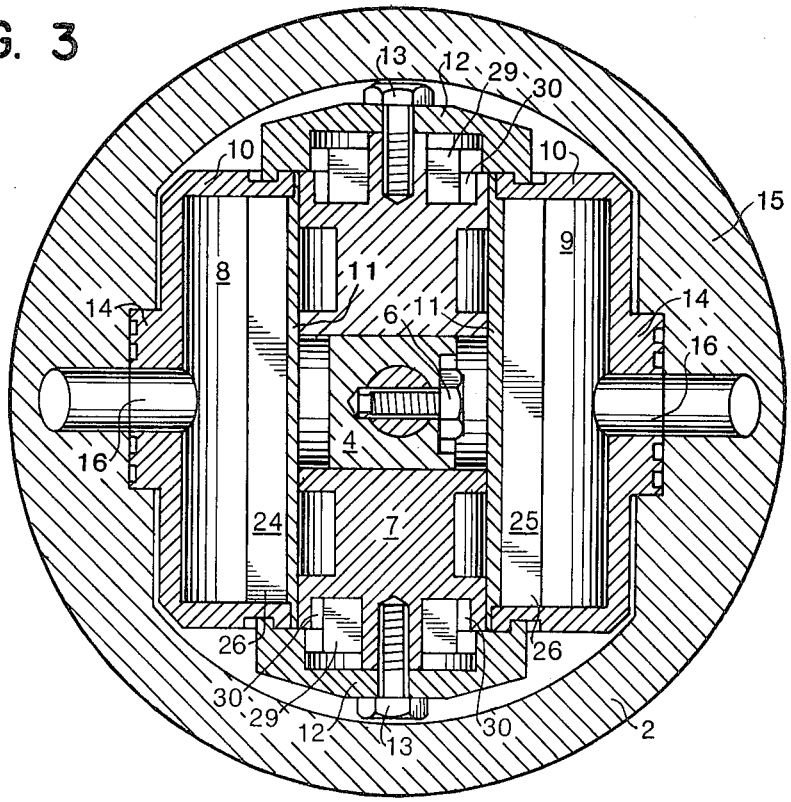
FIG. 3 is a partial view of a variant, in which the chambers are rectangular, in cross section along a plane perpendicular to the through axle and passing through the axis of the central pivot.
Figure 9:
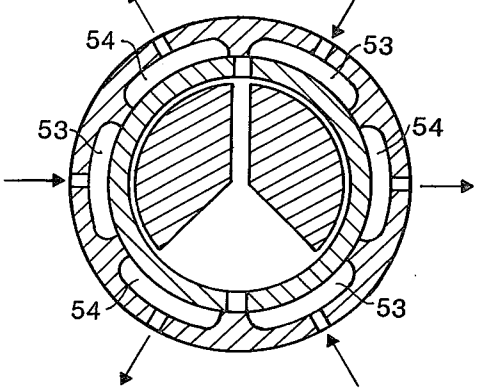
FIG. 9 shows the distribution face of the distribution stator of a machine working as a pump or a compressor with a cycle of three cycles each of two strokes.

In FIG. 3, one sees the detail of the securement of the shells 10, 11 on the central pivot 7 by means of locks 12 and screws 13.

One sees that the upper edge of the outside shell 10 is located on a shoulder provided at the upper edge of the inside shell 11. The locks 12 are secured on top of these two shells 10, 11 to maintain them in axial position with respect to the central pivot 7 and simultaneously, thanks to the outside shoulder of the lock the radial position of the shells 10, 11 with respect to the central pivot 7. This fixation enables also to ensure the fluid tightness between the edges of the shells which are in contact.

In FIG. 3 there is shown a variant in which the chambers 8, 9 have a rectangular cross section. This is possible due to the fact that with respect to these chambers 8, 9, the pistons effectuate a simple angular movement formed only by a rotation around the central pivot 7 with which the chambers are fast and concentric.

The construction and the design of the described machine have a certain number of characteristics which are therewith achieved.

1. During the rotation of the through axle 1, the rotation of the distribution ring 15 takes place at the same speed V1 and without any translation or inclination of this ring 15. This greatly facilitates the inlet and exhaust of the chambers 8,9.

2. Due to the relative rotation of the eccentrics 31, 32 relative to each other and to the through axle 1, the active faces of the pistons 22, 23 approach and retreat from each other, thereby causing a modification of the volume of the chambers 8, 9.

During this movement, the axes of the pistons describe a cone, the summit of which is located at the point of intersection 0 of the axis of the central pivot 7 and of the passing axle 1, while the pistons do not revolve on themselves, due to the sliding between them and their eccentrics. This is made possible due to the fact that the piston has a large opening giving passage to the through axle 1. This opening is at least equal in surface to the intersection of the piston with a conical surface the summit of which is located at the point 0 and the base of which is constituted by the edges of the active portion of the corresponding eccentric.

Also during this movement, the central pivot 7 makes an angular oscillation, taking with it the chambers 8, 9 and the shells 10, 11 which are rigidly fast therewith, around a central cylindrical bearing 4, causing a modification of the inclination of the axis of the central pivot 7 with respect to the axis of the through axle 1.

A movement of rotation takes place between the active portions of the eccentrics 33, 34, and the respective pistons 22, 23, so that these pistons do not revolve on themselves, while the eccentrics 31, 32 revolve around the axis of the through axle 1.

As a result the movement of the pistons 22, 23 with respect to the chambers 8, 9 is a simple pivotment around the central pivot 7. Therefore the chambers need not necessarily be spherical, but can have any shape provided that the external and internal surfaces of these chambers are surfaces of revolution having the axis of their central pivot for the revolution axes. It is therefore possible to design chambers the outside or inside sideline of which is curved, in an arc of circle, zig-zag lines, rectangular or so on.

Figure 5:
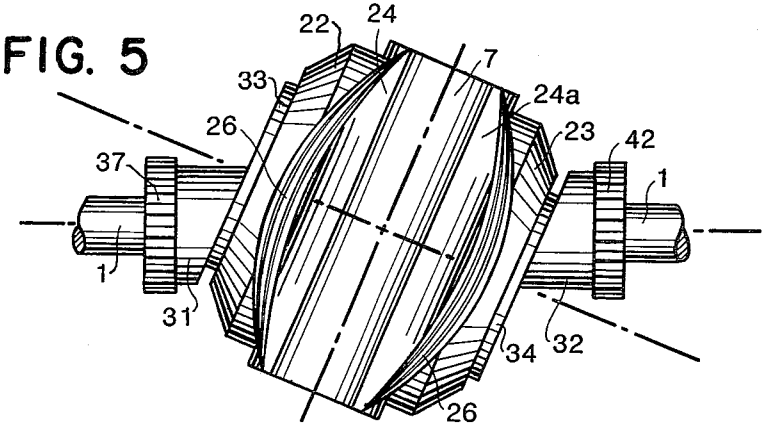
FIG. 5 is a partial, schematic view corresponding to the members shown in FIG. 4, the pistons being this time in their middle position, the view being not taken from above but from the side.
Figure 4:
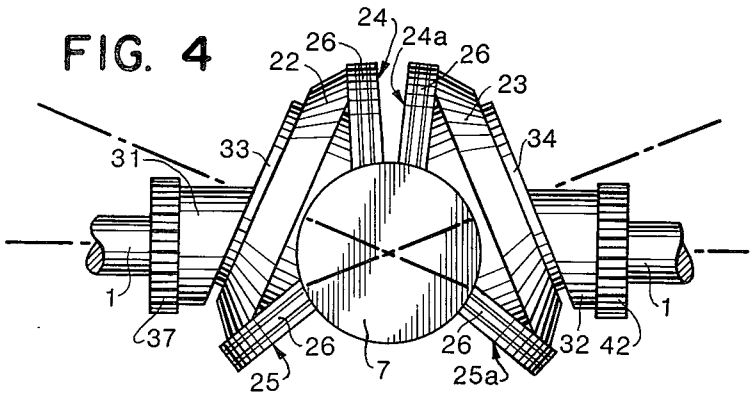
FIG. 4 is a partial, schematic view of certain movable parts of the machine in the position shown in FIG. 1.
Figure 6:
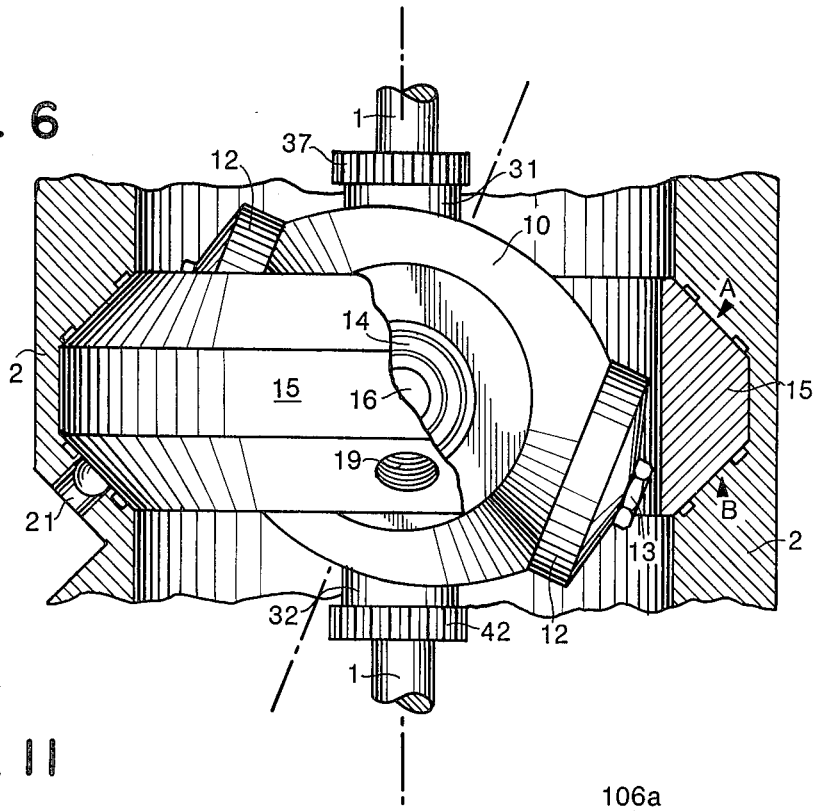
FIG. 6 is a partial side view, certain parts being cutaway, of the machine shown in FIG. 1.

3. As seen in FIG. 4, when the eccentrics are in opposition, the central pivot 7 is perpendicular to the through axle 1. In this position, the pistons 22, 23 are at their extreme positions. However when the eccentrics are located in parallel planes, their axes being then aligned, the central pivot 7 has a maximum inclination with respect to the through axle 1. In this position, the pistons are in their middle position (FIG. 5).

4. The active portions of the eccentrics 33, 34 can have very large dimensions without limiting the opening angle between the two active faces of the two pistons 22, 23 due to the fact that these eccentrics are located very close to the center of the unit and that they can move within the chambers 8, 9. This disposition is possible due to the large opening of the pistons enabling them to move around the through axle 1.

5. The distribution ring 15 revolves at the same speed and in the same direction as the through axle 1, these elements can be rigidly connected the one to the other, by a casing. This casing would replace the cranks 40, 45 and would carry the planets 38, 43 and 43*a*. This permits having a rigid construction and transmitting the torque not only by the axle 1, but also through this distribution ring 15 and the casing. It is thus possible to achieve a very compact motor comprising an outside distribution ring, but having nevertheless a small diameter which is important for high rotation speeds.

6. The forces are equally distributed on the two eccentrics having large dimensions.

7. The pistons do not apply forces against the walls of the chambers, other than those due to the sealing segments. This reduces greatly the wear of the pistons and of the chambers. The active faces of the pistons are self centering.

8. One can mount several units in line on a same through axle. In this case, the units are mounted so that the central pivots oscillate in opposition to balance the assembly.

9. It is known that during the explosion or the combustion of a gas mixture, the gas tends to be strongly projected towards the outside. This is favorable in this construction since the pistons have a greater active surface towards the outside than at the center. The explosion force is divided on two active faces and thus on two bearings of the eccentric, and, the forces are better distributed for example in the case of a diesel motor.

10. The machine is well balanced due to the fact that the two chambers are fast with the central pivot and that the out of balance masses constituted by the pistons and the eccentrics can easily be compensated by counterweights.

Figure 7:
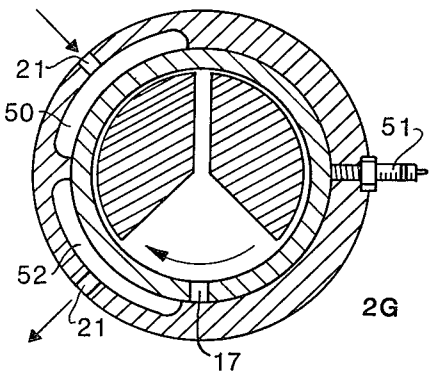

To have the machine operate as a combustion engine having a four strokes cycle (FIG. 7 and 8) one may:

(a) provide for demultiplication ratios between the through axle 1 and the eccentric 31 respectively 32 of 1:2 respectively of 1:−2. Thus, for one complete revolution of the through axle 1, the pistons make two reciprocations in their respective chambers, which corresponds to a complete cycle.

(b) provide that the housing 17, respectively 18 of the distribution ring 15 relating to the chambers 8 respectively 9 open on two opposite sides of this distribution ring 15.

Figure 8:
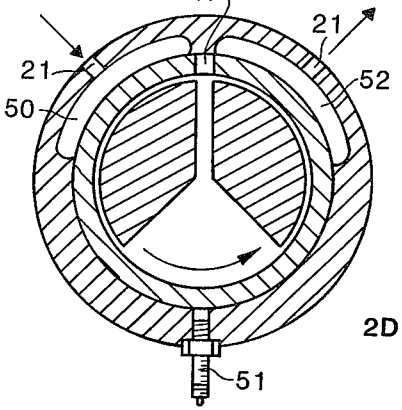
FIGS. 7 and 8 show schematically the distribution stator seen from A respectively from B (FIG. 1).

(c) provide openings in the right side of the frame 2 (FIG. 8). One admission opening 50 has an extension of approximately 90° followed by a closed zone of approximately 90°. An ignition 51 at this point is constituted for example by a spark plug, followed by another closed zone of approximately 90° which is itself followed by an outlet opening 52 extending approximately 90°.

(d) provide in the left side of the frame 2 (FIG. 7) the same opening 50, 52 and an ignition 51, but shifted by 90° with respect to the right side of the stator.

This shifted disposition of the openings and of the sparkling points is necessary due to the fact that when one chamber has its minimum volume, that is at the beginning of its admission, the other chamber is at is maximum volume. As the ignition is located 180° from the beginning of the admission, one sees that a shifting of the admission, output and igniters 90° is necessary between the two chambers 8 and 9.

For the machine to operate as a compressor one can for example:

(a) have a ratio of 1:3 respectively 1:−3 between the eccentrics 31, respectively 32 and the through axle 1.

In that way for each complete revolution of the axle 1 the pistons of a same chamber make three reciprocations.

(b) As the cycle has only two phases, compression and admission, the housings 17, 18 can open on the same side of the distribution ring and provide on the stator a succession of openings, having an extent of about 60° for admission 53 and exhaust 54 alternately.

Very numerous variants of this machine can be thought of. One could have only one chamber and two simple pistons instead of double pistons. Similarly one can have only one double or simple piston cooperating with two respectively one chamber. In this case, the chambers are closed at one of their front ends by a fixed member.

One could also have a fixed through axle and kinematic linkage means driving the eccentrics 31, 32 in rotation around the through axle 1 at equal speeds in opposite directions.

Under such conditions, the pistons have only a pivoting movement around the axis of the central pivot 7 and an oscillation corresponding to that of said central pivot. The chambers 8, 9 only oscillate on themselves around the bosses 14. For the distribution of such a machine having a fixed through axle one can provide valves, or any other opening system between the oscillating parts and the frame.

It is also possible to have chambers of different dimensions, the piston having then each a large and a small active surface. Such a design permits providing a two stage compressor.

Figure 10:
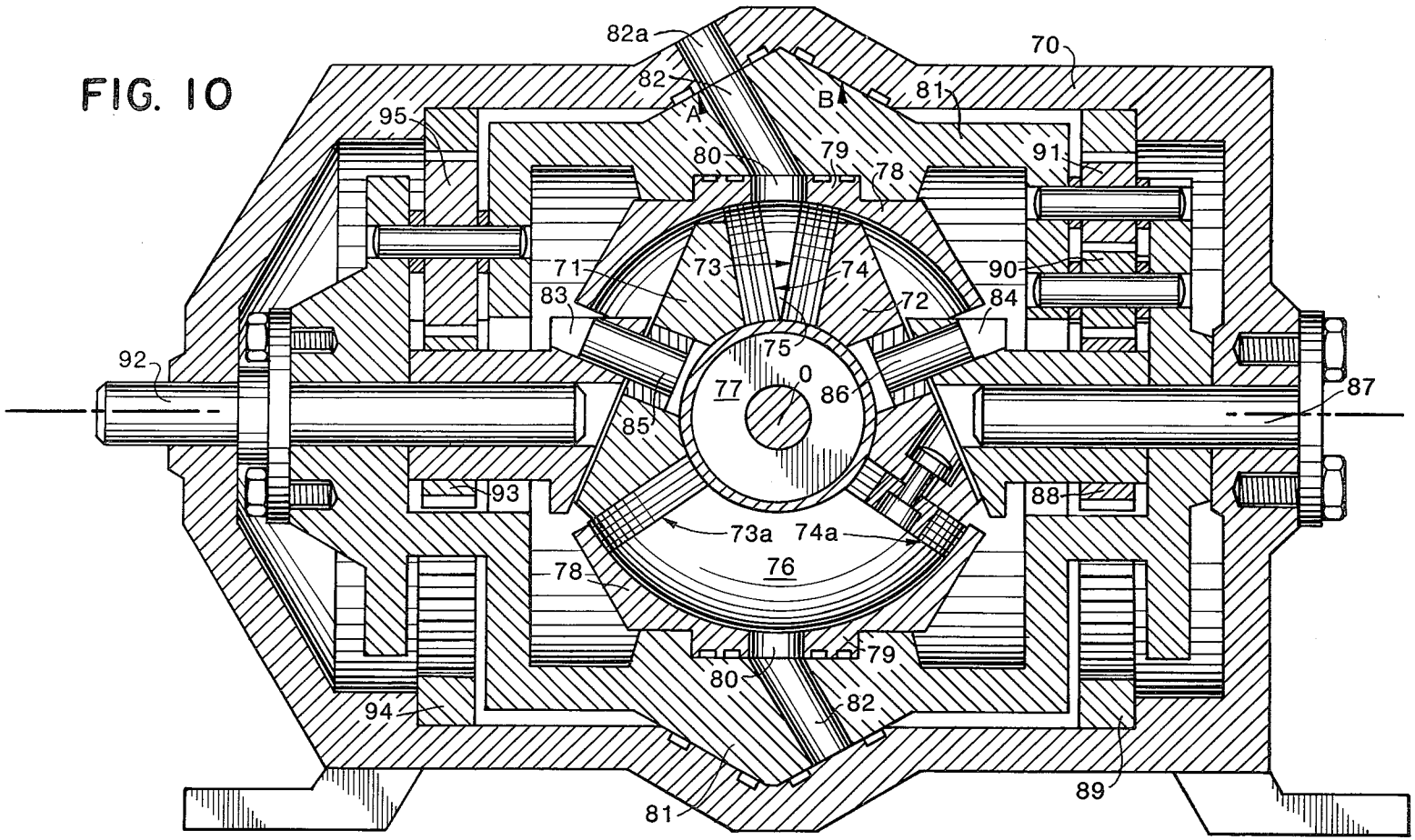
FIG. 10 shows in cross section a second embodiment of the machine.

A second embodiment of the machine is shown in FIG. 10. This machine comprises also only one active unit to simplify the description and its representation. This machine comprises a fixed frame 70 housing all the movable parts of the machine. This machine comprises also two pistons 71,72 having each two active faces 73, 74; 73*a*, 74*a* formed, as in the first embodiment described by built-up parts adapted to move with respect to the pistons parallel to the active faces 73, 74 for a self centering of these parts in the chambers 75, 76.

These pistons 71, 72 are, as in the first embodiment, axially and radially guided on a central pivot 77. The outside surface of this central pivot 77 constitutes the internal wall of the chambers 75, 76. The outside walls of these chambers 75, 76 are here also comprised by shells 78 fast with the central pivot and having coaxial pivots 79 perpendicular to the axis of the machine and to the axis of the central pivot 77 and passing through the point of intersection 0 of these two axes.

These pivots 79 have passages 80 and are located in housings provided in a distribution casing 81 having passages 82 communicating on the one hand with the passages 80 and on the other hand with admission and exhaust openings 82*a* as well as with an ignition member in the case of a combustion engine, provided in or fixed on the frame 70.

The machine comprises further two eccentrics 83, 84 the active portions of which, constituted by trunnions 85, 86, are housed in corresponding bearings provided in the pistons 71, 72. The eccentric 84 is journaled on a shaft 87 rigidly secured to the frame 70 and extending coaxially with the longitudinal axis of the machine. This eccentric 84 comprises a pinion 88 coaxial to the fixed shaft 87 kinematically linked to a toothed crown 89 by means of two planets 90, 91 idly pivoted on axes fast with the distribution casing 81.

The other eccentric 83 is journaled on a control member, formed here by a driving shaft 92, pivoted in the frame coaxially with the longitudinal axis of the machine.

This drive shaft 92 is rigidly fastened to the distribution casing 81. The eccentric 83 carries a pinion 93 kinematically linked to a toothed crown 94 fast with the frame 70, by means of a planet 95 idly pivoted on an axis fast with the distribution casing 81.

It is to be noted that here also the axes of the active portions 85, 86 of the eccentric pass both through the point of intersection 0 of the longitudinal axis of the machine and the axis of the central pivot 77.

The kinematic linkage 93, 94, 95 connecting the eccentric 83 to the distribution casing 81 and 88, 89, 90, 91 connecting the eccentric 84 to this same distribution casing 81 having ratios such that with respect to this distribution casing 81, the eccentric revolve at the same speed but in opposite directions.

In this embodiment the machine has no through axle and the central pivot is only held by the distribution casing 81 through the shells 78 with which it is fast.

It is to be noted that the omission of the through axle is made possible by the fact that one active unit having two pistons as described does not cause any axial thrust in the direction of its longitudinal axis of the machine, since the chambers 75, 76 are fast with the central pivot 77. All the energy developed in the chambers 75, 76 is transmitted to the control member or drive shaft 92, by the eccentric, the kinematic linkages and the distribution casing.

It is evident that variants of this second embodiment of the machine can be provided in which one could have only one double piston or only one chamber cooperating with one or two simple pistons.

Figure 11:
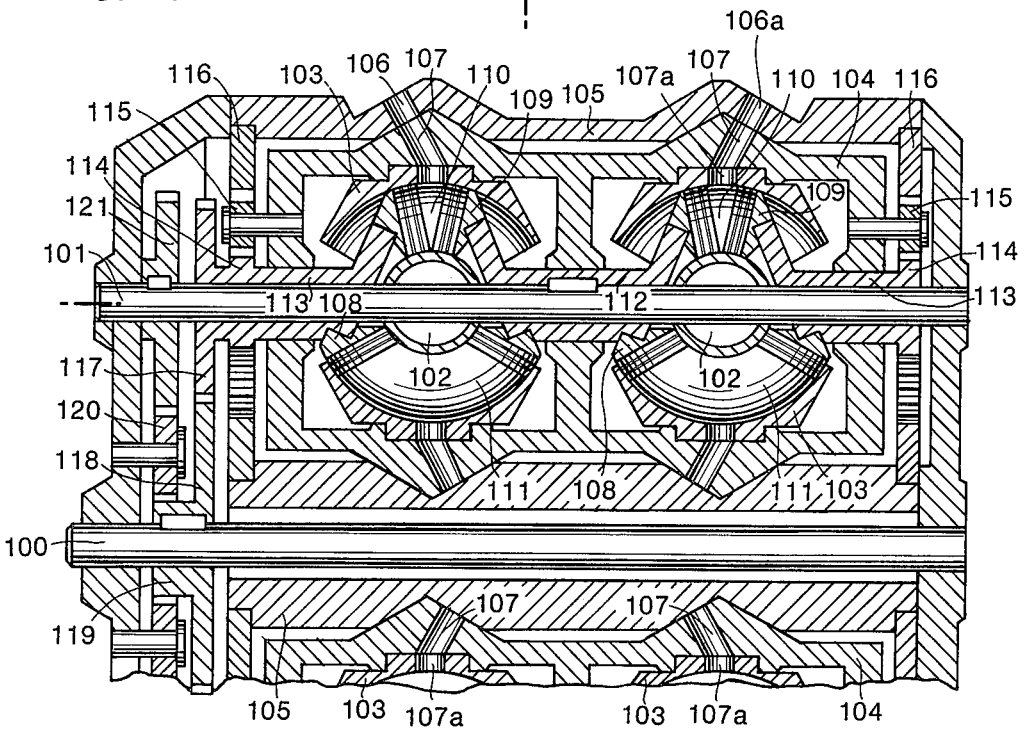
FIG. 11 shows very schematically a third embodiment of a machine having several active units connected to a central drive shaft.

The third embodiment of the machine shown in FIG. 11 is a machine comprising several active units, four in the example shown.

This machine comprises two groups of two units mounted in parallel on a drive shaft 100. Each of these groups comprises two units mounted in series on a through axle 101.

In this realization each active unit comprises an oscillating central pivot 102 rotatively mounted on a through axle 101. This central pivot 102 is rigidly connected, as in the previous embodiment described, to two chambers comprising shells 103 fast in rotation with the distribution casing 104 around the through axle 101. In this construction a distribution casing 104 cooperates with two active units. As in the embodiments described previously, this distribution casing 104 cooperates with the frame 105 which is fixed, and connects alternately the chambers of the units to the admission 106 and exhaust 106*a* openings in this frame 105. Channels 107 of the distribution casing 104 and 107*a* of the shells 103 are provided therefor.

In this embodiment, each active unit comprises also two pistons 108, 109, the active faces of which move within chambers 110, 111. These pistons are guided on the ends of the central pivots 102 as in the previous embodiments.

Also these pistons 108, 109 are turning on the active portions of eccentrics 112, 113, the axes of which intersect at the point of intersection 0 of the axes of the central pivot 102 and the through axle 101.

The eccentric 112 of each active unit is here fast with the through axle 101, whereas the other eccentric 113 of each active unit is journaled concentrically to the through axle and is connected by means of a kinematic linkage to the distribution casing 104, which constitutes in the embodiment this control member.

This kinematic linkage comprises a pinion 114 fast with the eccentric 113, coaxial to the through axle 101, meshing with a planet pinion 115 idly pivoted on an axis carried by the distribution casing 104 and simultaneously in mesh with a toothed crown 116 fast with the fixed frame 105. This kinematic linkage is such that the eccentric 113 revolves around the through axle 101 in the same direction as the distribution casing 104, but at a greater speed.

In this embodiment, the distribution casing 104 constitutes the control member of two coaxial active units.

One of the eccentrics 113 carries a pinion 117 coaxial to the through axle 101 meshing with a toothed wheel 118 fast with the drive shaft 100.

Finally this drive shaft 100 comprises further a pinion 119 meshing with a planet pinion 120 idly pivoted on a shaft fast with the fixed frame 105. This planet 120 meshes with a toothed wheel 121 fast with the through axle 101.

The ratios of the different kinematic linkages are always such that the relative speeds of rotation of the eccentrics 112, 113 with respect to the control members, here the distribution casing 104, are equal but in opposite directions.

In the example shown, the ratio between the toothed wheel 118 and the pinion 117 is 1.5:1, that between the pinion 119 and the toothed wheel 121 is 1:2 and that between the excenter 113 and the distribution casing 104, i.e. the linkage 114, 115, 116 is 1:2.

Thus, when the distribution casing 104 makes a revolution in one direction, the eccentric makes with respect to the casing 104, two revolutions in the same direction and the eccentric 112, fast with the through axle 101, makes two revolutions in the opposite direction. So, with respect to the frame 105, on revolution of the distribution casing 104 corresponds to three revolutions in the same direction of the eccentric 113 and to one revolution in the opposite direction of the eccentric 112.

In this way, one revolution of the drive shaft 100 corresponds to $\frac{1}{2}$ turn of the distribution casing 104, that is to one opening and one closure of the pistons 108, 109.

The disposition of this third embodiment of the machine is very compact, it permits the coupling of several groups of active units in a small space, grouped around only one drive shaft.

In a general way, one has always in all possible embodiments of the machine according to the invention the following characteristics:

1. One or several chambers fast with an oscillating central pivot.

2. One control member fast in rotation with the chambers around an axis coaxial to the axis of rotation of one or several eccentrics.

3. Kinematic linkages imposing relative rotations of the eccentrics, with respect to a control member, having the same speed but in an opposite direction. This is always the case whatever the control member is; i.e. constituted by the through axle or by the distribution casing or ring.

4. Pistons turning on the active portions of the eccentrics and axially and angularly guided with respect to the oscillating central pivot, the active surfaces of which move within the chambers for varying their volume. The movement of the piston in the chambers is always only a pivoting around the central pivot with which the chambers are fast.

5. Preferably, the pistons are pivoted around a central oscillating pivot to avoid any friction between them and the chambers other than that due to the sealing members.

What I claim is:

1. Machine having oscillating chambers and pistons, comprising a control member having an axis, a central pivot having an axis and being fixed against rotation relative to said control member but oscillable relative to said control member about an axis perpendicular to and intersecting the axis of said control member; the path of oscillation of said central pivot axis crossing on opposite sides of a plane perpendicular to said control member axis and passing through said intersection; at least one eccentric comprising a rotary bearing having an axis which is disposed at an acute angle to the axis of the control member and passes through said intersection; at least one piston turning on said rotary bearing and pivoted concentrically to the axis of said central pivot, said at least one piston having at least one surface moving inside at least one chamber, said at least one chamber being fixed against movement relative to said central pivot; and drive means to cause relative rotation between the eccentric and the control member.

2. A machine as claimed in claim 1, in which said control member is a drive shaft secured to a casing which turns with said chamber.

3. A machine as claimed in claim 1, and a second chamber secured to the central pivot opposite the first-mentioned chamber, there being a second said piston which moves within said second chamber in a direction opposite that of movement of the first-mentioned piston.

4. A machine as claimed in claim 1, and a second piston turning on a second eccentric, said second eccentric having an axis which passes through the intersection of the axes of the central pivot and of the control member, and drive means imposing on said second eccentric a more rapid rotation than, and in a direction same as the control member.

5. A machine as claimed in claim 1, in which said chamber is constituted by a shell forming an outside wall of the chamber, an internal wall of said chamber being constituted by an external surface of said central pivot.

6. A machine as claimed in claim 1, in which said pistons have peripheral sealing members that permit self-centering of each of the pistons.

7. A machine as claimed in claim 1, in which the eccentric and the central pivot having equal speed of rotation but rotate in opposite directions.

8. A machine as claimed in claim 1, in which said chamber has inner and outer surfaces which are surfaces of revolution whose axis coincides with the axis of the central pivot.

9. A machine as claimed in claim 8, in which said outer surface of the chamber is a portion of a sphere.

10. A machine as claimed in claim 1, and an annular distribution ring secured for rotation with the at least one chamber about said axis of the control member.

11. A machine as claimed in claim 10, in which said distribution ring comprises a precombustion chamber intercommunicating with the last-mentioned chamber.

12. A machine as claimed in claim 1, wherein several such machines are disposed in a casing.

13. A machine as claimed in claim 12, said casing having at least one bearing in which said eccentric of each machine is journalled for rotation.

14. A machine as claimed in claim 1, and a second piston turning on a second eccentric, the axis of the second eccentric passing through the intersection of the axes of the central pivot and the control member, and drive means causing said second eccentric to rotate, with respect to said control member, at a speed same as the first-mentioned eccentric, but in an opposite direction.

15. A machine as claimed in claim 14, in which said drive means positively drivingly interconnects both said eccentrics to the control member.

16. A machine as claimed in claim 14, in which said drive means connects one of said eccentrics to a control casing, the other said eccentric being secured to the control member.

17. A machine as claimed in claim 1, and means guiding said piston axially and radially on said central pivot.

18. A machine as claimed in claim 17, in which the last-named means are disposed outside the chamber in the vicinity of the piston.

19. A machine as claimed in claim 18, in which there are two pistons each having said guide means.

20. A machine as claimed in claim 1, in which said control member is a casing which turns with said chamber, said drive means causing relative rotation between said eccentric and the casing.

21. A machine as claimed in claim 20, including a through axle to which said eccentric is fixed for rotation.

22. A machine as claimed in claim 20, in which said drive means positively drivingly connect the eccentric to the casing.

23. A machine as claimed in claim 1, in which the control member is a through axle that passes through at least one said eccentric.

24. A machine as claimed in claim 23, in which during one revolution the eccentric penetrates inside said chamber.

25. A machine as claimed in claim 24, in which said eccentric penetrates inside the area of the chamber which is swept by the piston.

26. A machine as claimed in claim 23, in which said drive means positively drivingly interconnect the eccentric and the through axle.

27. A machine as claimed in claim 26, in which the drive means connect each eccentric to the control member by means of an external shaft.

* * * * *